United States Patent [19]

Gregor

[11] 4,384,652

[45] May 24, 1983

[54] COKE-OVEN-DOOR-EXTRACTING APPARATUS AND METHOD

[75] Inventor: Karl Gregor, Bochum, Fed. Rep. of Germany

[73] Assignee: Gewerkschaft Schalker Eisenhütte, Gelsenkirchen-Schalke, Fed. Rep. of Germany

[21] Appl. No.: 967,002

[22] Filed: Dec. 6, 1978

[30] Foreign Application Priority Data

Dec. 10, 1977 [DE] Fed. Rep. of Germany ..... 2755106

[51] Int. Cl.[3] ..... C10B 25/14

[52] U.S. Cl. ..... 212/166; 202/248

[58] Field of Search ..... 212/4, 166; 202/248, 202/241; 49/148, 13; 414/684.3

[56] References Cited

U.S. PATENT DOCUMENTS

| | | | |
|---|---|---|---|
| 2,182,494 | 12/1939 | Lavely | 212/4 |
| 2,819,802 | 1/1958 | Hart | 212/4 |
| 4,126,520 | 11/1978 | Horster | 212/4 X |

FOREIGN PATENT DOCUMENTS

| | | | |
|---|---|---|---|
| 918744 | 10/1954 | Fed. Rep. of Germany | 212/4 |

*Primary Examiner*—Leslie J. Paperner

*Attorney, Agent, or Firm*—Karl F. Ross

[57] ABSTRACT

A coke-oven door, fitting within its frame with a predetermined vertical play, is extractable therefrom by an apparatus comprising vertically movable lifting elements on a horizontally displaceable support, the lifting elements being operable by a hydraulic cylinder with the aid of a controller responsive to the output of a pulse generator coupled with these elements. The controller includes a pulse counter which is stepped forward by the pulse generator after an initial upward motion (a) of the lifting elements from a lower limiting position, designed to fully engage these elements with coacting projections on the door, the lift being halted when a predetermined count has been reached to indicate a break-free level at which the door is substantially centered in its frame. The door is then horizontally withdrawn on the support and, when clear of the frame, is further elevated to a cleaning level at which the lifting elements have reached an upper limiting position. After cleaning, the door is lowered to the break-free level with backward stepping of the counter until it reaches again the predetermined count. Following reinsertion of the door into the frame, the lifting elements are lowered further to return the door to its initial position and to detach it from the apparatus.

4 Claims, 14 Drawing Figures

COKE-OVEN-DOOR-EXTRACTING APPARATUS AND METHOD

FIELD OF INVENTION

The present invention relates to a method of and apparatus for extracting the door of a coke oven. More particularly, my invention concerns an apparatus which automatically breaks free and removes the door from a coke oven of a battery of such coke ovens.

BACKGROUND OF THE INVENTION

A battery of coke ovens is provided along each side with a row of doors each opening into a respective end of a respective coke oven. These doors are relatively tall and massive, as they serve to hold the entire coal charge inside the respective coke oven during the distillation thereof. These doors must also form a tight seal with the respective surrounding frame aperture so that on the one hand air cannot enter the coking chambers to allow combustion of the coal, and on the other hand the leakage of dangerous gases such as carbon monoxide to the surrounding areas is prevented. At the same time the doors must be able to withstand the enormous heat generated during the coking process.

In order to push the coke charges out of the ovens after the coking process is completed, it is necessary to remove the doors from the ends of each coking oven. Even after opening the heavy latches that hold them shut, these doors normally remain tightly lodged in place as a result of accumulations that collect during the coking process. Thus, the doors must be broken free before they can be extracted from the ovens.

Generally, a door extractor engaging coacting elements of the oven doors is operated so as to lift them slightly. To this end an operator normally supervises the door extraction, ensuring that each door is raised sufficiently within its frame aperture, in which the door is received with considerable play, so as to break the door free of the frame. Then each door is withdrawn.

After this withdrawal the door is normally transported to a cleaning machine which scrapes from it and from its seal the accumulations that form during the coking process. Thereafter the door must be repositioned exactly in line with the respective frame aperture and reinserted into same. The latches are then secured and a new coking cycle may commence.

Such a procedure must be carried out with extreme care so as not to damage the seals provided on the doors and the frames. Thus it is critical that each door be lifted through a predetermined relatively short distance to break it free, since if not lifted enough the door will not be detached whereas if lifted too high it will become wedged against the upper edge of the frame. Similarly, the door must be exactly centered in front of the respective frame before it can be reinserted.

OBJECTS OF THE INVENTION

It is therefore an object of the present invention to provide an improved method of and apparatus for extracting the door from a coke-oven battery.

Another object is to provide such a method and apparatus which work completely automatically while taking into account possible variations in the heights of different doors of the ovens of a battery.

SUMMARY OF THE INVENTION

In accordance with one aspect of my invention, an apparatus for extracting a door from a frame aperture of a coking oven, accommodating that door with a predetermined vertical play or clearance, comprises lifting means mounted on a horizontally displaceable support for relative vertical movement between a lower and an upper limiting position that are separated by a distance substantially exceeding the aforementioned play, the lifting means being engageable from below with coacting means on the door and being coupled with a pulse generator. A device controlling the operation of a preferably hydraulic actuator for the lifting means includes a pulse counter which is connected to the pulse generator and is enabled by a start signal, emitted by a switch responsive to operative engagement of the lifting and coacting means, during an upward stroke of the lifting means from the lower limiting position thereof and with the coacting means engaged, the counter so enabled being stepped forward by the pulse generator to count a number of pulses proportional to the rise of the door in its frame aperture. Upon the elevation of the door to a break-free level substantially midway within the frame aperture, as indicated by an equality between the pulse count and a predetermined reference value, a comparator with inputs connected to the counter and to a source of that reference value emits a stop signal deactivating the actuator for the lifting means, this actuator being reactivable upon a horizontal withdrawal of the door on the support from its frame aperture; such reactivation continues the upward stroke and the forward stepping of the pulse counter until the upper limiting position of the lifting means is attained. In that upper limiting position the door may be subjected to the usual cleaning operation whereupon the actuator can be reversed with backward stepping of the pulse counter and re-emission of the stop signal by the comparator upon return of the door to its break-free level whereby the door can be returned to its frame aperture and lowered into its initial position therein.

Another aspect of my invention resides in a method of temporarily extracting a door from a frame aperture of a coking oven in conformity with the mode of operation of the apparatus just described. This method, accordingly, comprises the following steps:

(a) elevating a lifting element, engaged with a coacting element on the door, to raise the latter in a resting position on a sill of its frame aperture by a distance less than the predetermined play or clearance with which the door is received in that aperture, (b) generating a series of forward-counting pulses, at a rate proportional to lifting speed, during the raising of the door in step (a) and stopping the lift upon the pulse count equaling a predetermined reference value which corresponds to a rise by about half that play to a break-free level, (c) horizontally moving the lifting element to withdraw the door from its frame aperture at that break-free level, (d) thereafter elevating the lifting element and the door into a higher position for cleaning while continuing the generation of forward-counting pulses, (e) storing the pulse count attained in this higher position, (f) lowering the lifting element with the cleaned door while generating a series of backward-counting pulses diminishing the stored count and halting the door at the break-free level as determined by a count equal to the reference value, (g) reinserting the door into its frame aperture by reverse horizontal motion at break-free level, and (h) lowering the lifting element to return the door to its resting position.

When the lifting element initially occupies a disengaged position from which it is raised prior to step (a) into engagement with the coacting element on the door, step (h) is followed by a lowering of the lifting element into its disengaged position.

BRIEF DESCRIPTION OF THE DRAWING

The above and other features of my invention will now be described in detail with reference to the accompanying drawing in which.

FIGS. *7a–7g* are schematic views illustrating the operation of the system according to this invention.

SPECIFIC DESCRIPTION

Figure 1:
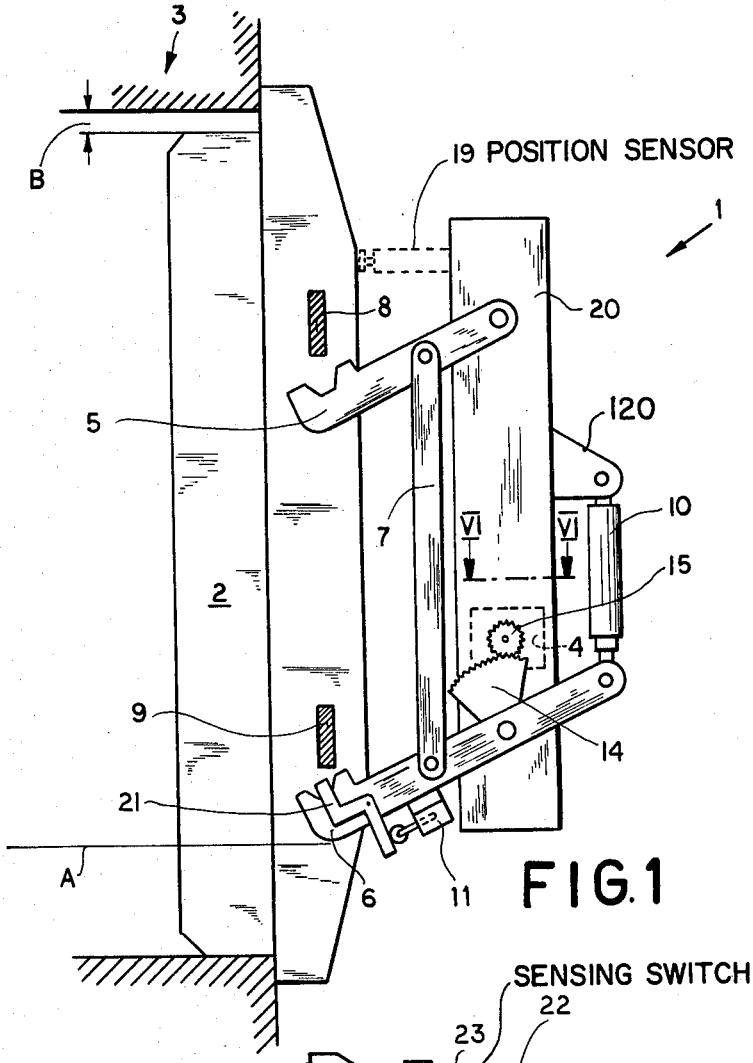
FIG. 1 is a side view, partly in section, of an apparatus according to this invention.

As shown in FIG. 1, a door-lifting mechanism 1 according to this invention operates on an upright coke-oven door 2 received within a frame 3 with a vertical play B, here of 50 mm. The lifting mechanism 1 has a basic support 20 which can be moved horizontally with respect to the frame 3 and, advantageously, can also be pivoted about a vertical axis. This support 20 houses a pulse generator 4 and carries a pair of similar fork arms 5 and 6 that are pivotable thereon about respective horizontal, vertically spaced axes and are interconnected by means of a vertical link 7. The fork arms 5 and 6 are respectively engageable with coacting horizontal bars 8 and 9 on the door, and a heavy-duty hydraulic cylinder 10 is inserted between the far end of the lower arm 6 and a lug 120 on the support 20 so that extension of its piston raises the arms 5 and 6 to cradle the bars 8 and 9 whereas retraction of that piston lowers the arms 5 and 6.

A switch 11 is provided on the lower arm 6 and is operated by means of a tripping lever 21 so that it closes once the lower bar 9 is firmly cradled within the bifurcation of arm 6. Thus, switch 11 generates a start-lift signal as will be described below.

Figure 6:
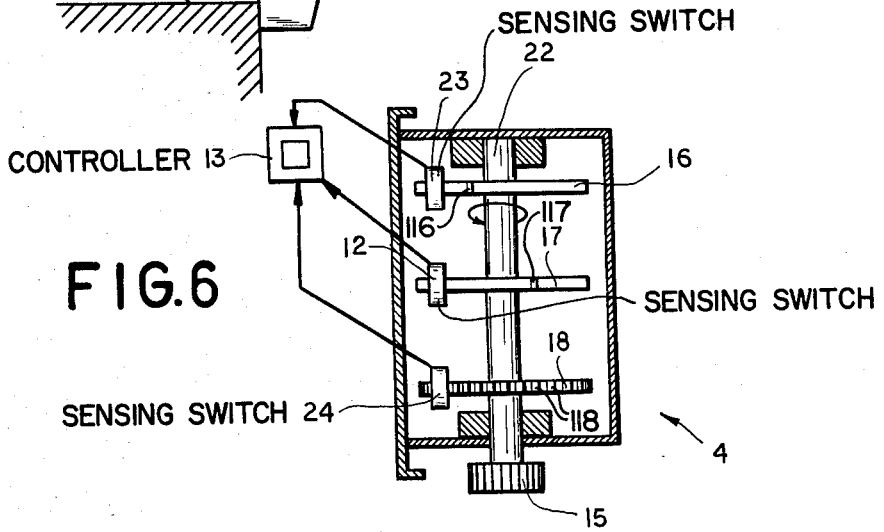
FIG. 6 is a partly schematic view taken along line VI—VI of FIG. 1.

The pulse generator 4, as shown in FIG. 6 has a central shaft 22 parallel to the pivotal axes of arms 5 and 6; a pinion 15 at one end of shaft 22 meshes with a sector gear 14 fixed to the lower arm 6. This shaft 22 also carries three cam disks 16, 17 and 18. The periphery cam 18 has a series of angularly equispaced notches or bumps 118 that coact with a sensing switch 24 connected to a controller 13 more fully described hereinafter with reference to FIG. 8. The formations 118 on the disk 18 are spaced so that each time the outer ends of the arms 5 and 6 move through a relatively short incremental distance (much smaller than the play B) a counting pulse will be generated. The disk 17 cooperates with a sensing switch 12 and has a single lobe or bump 117 which causes the switch 12 to close when the arms 5 and 6 are in an extreme down position with the arm 6 at a level A. The disk 16 is similarly formed and has a projection 116 cooperating with a sensing switch 23 that is closed when the arms 5 and 6 are in an uppermost position, with the arm 6 at a level C (see FIG. 4) spaced above the position A by a distance d much greater than the play B. Sector gear 14 and pinion 15 constitute a step-up transmission translating a limited swing of the arms 5 and 6 between their uppermost and lowermost positions into a rotation of shaft 22 through approximately 300°.

With the apparatus according to the instant invention, therefore, the lifting mechanism is positioned in front of the door 2 resting as shown in FIGS. 1 and *7a* on the bottom edge or sill of the frame 3, with the lower arm 6 at level A and with the play B separating the upper edge of the door from the upper frame edge or lintel. A switch 19 on the support 20 informs the controller 13 that the door extractor is in lifting position.

Figure 2:
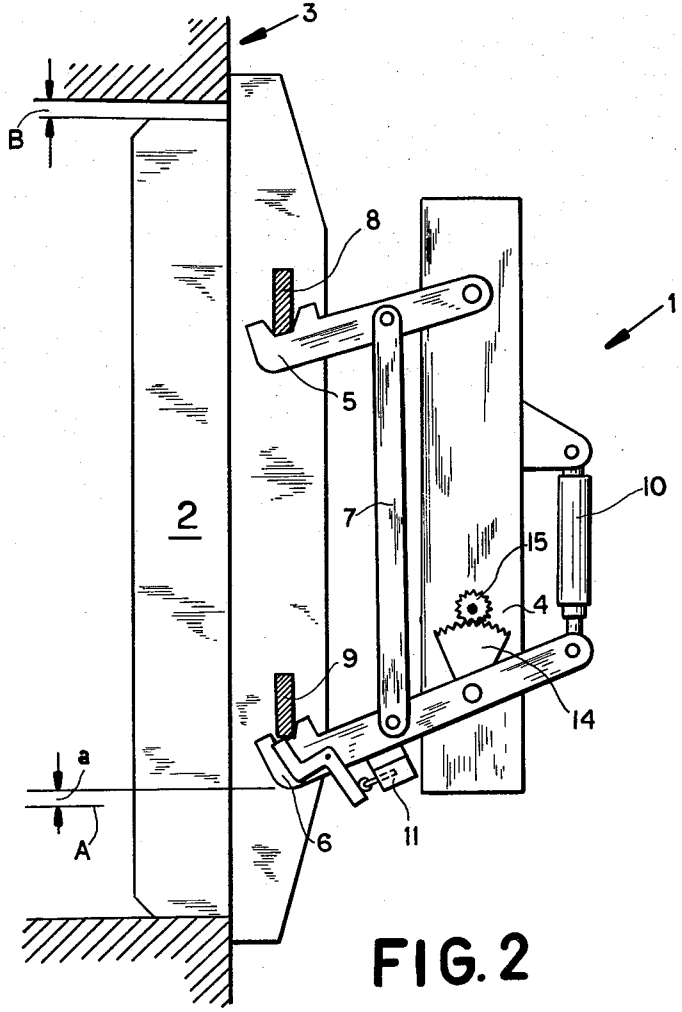

Thereafter, as shown in FIG. 2, the cylinder 10 extends its piston until the two arms 5 and 6 properly cradle the bars 8 and 9, respectively. The arms 5 and 6 are therefore displaced upwardly through a distance a from the lowermost position A until they have embraced the bars 8 and 9. Once the bar 9 is firmly engaged by the lower arm 6, the operating lever 21 of switch 11 is depressed and this switch 11 generates a start-lift signal that is fed to the controller 13 along with the incremental pulses which are being consecutively generated by the switch 24.

Figure 3:
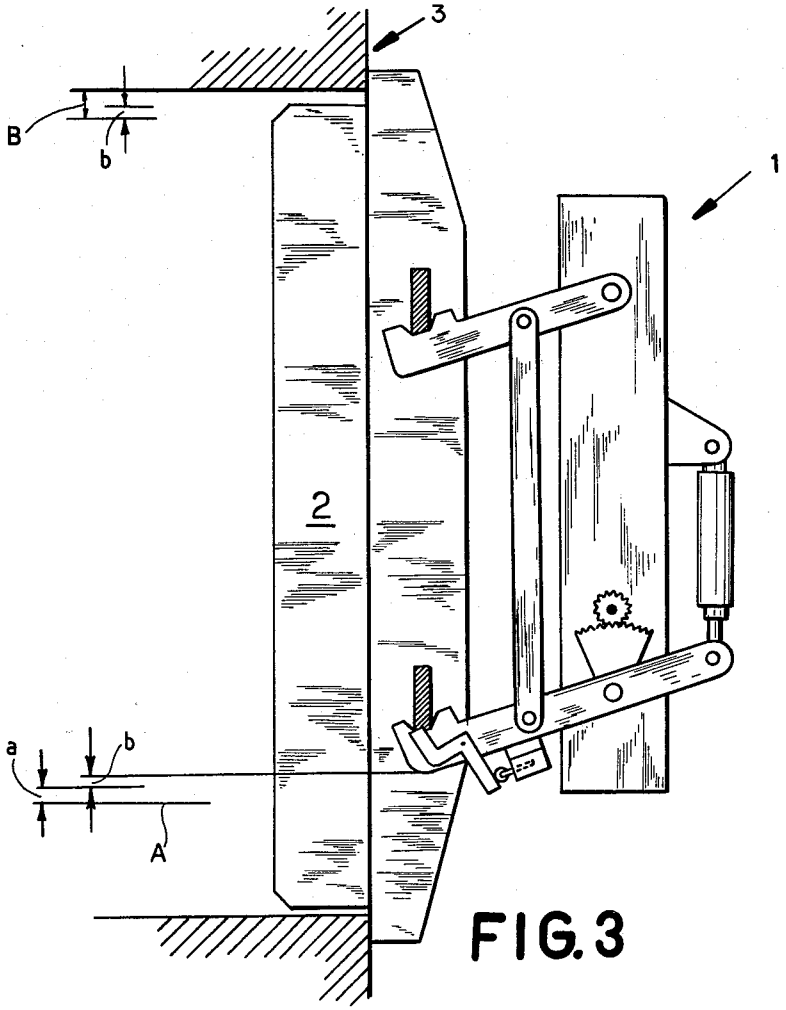
FIGS. 2, 3, and 4 are side views similar to FIG. 1, illustrating the mode of operation of the system according to this invention.

The lift continues, as shown in FIGS. 3 and *7b*, with the arms 5 and 6 raising the door through a distance b equal to 20 mm or about half of the play B. This action elevates the lower edge of the door 2 above the sill and frees it from the frame 3 without bringing the upper part of the door into engagement with its lintel. Displacement through the distance b is detected by the controller 13 which thereupon generates a signal that closes the operating valve for the cylinder 10 and stops the lift.

Thereafter, as shown in FIG. *7c*, the door 2 can be pulled horizontally out of the frame 3. As the door 2 is perfectly aligned centrally with the frame, it can easily be withdrawn therefrom.

Figure 4:
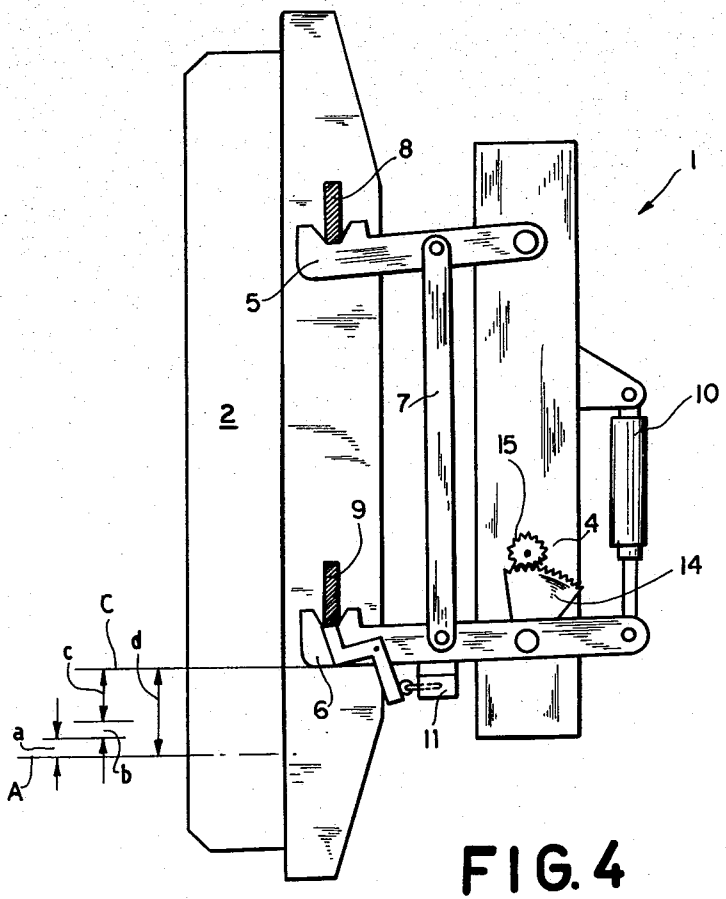

After the door 2 has been fully extracted to clear the frame 3, controller 13 is actuated manually or otherwise to command repressurization of the cylinder 10 to lift the door 2 through a distance c as shown in FIGS. 4 and *7d*, leaving the arm 6 at a level C spaced above level A by a distance d substantially greater than the play B. In this position a cleaner 25 may operate on the door 2 to remove from it any residue resulting from the preceding coking operation. Simultaneously, of course, the coke inside the oven is pushed out. The switch 23 connected to the controller 13 determines the upper position of the door 2, shown in FIGS. 4 and *7d* in accordance with a fixed location outside of the oven, unrelated to the break-free position.

After cleaning, as shown in FIG. *7e*, the door 2 is dropped back down through the distance c, which is determined by the controller 4 simply by counting backward to the intermediate position from whatever count it had reached when it stopped at its uppermost position.

Figure 7A:
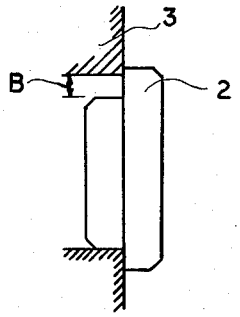
Figure 7B:
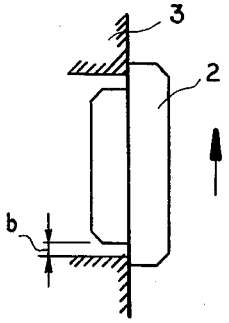
Figure 7C:
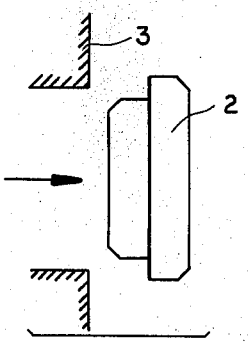
Figure 7D:
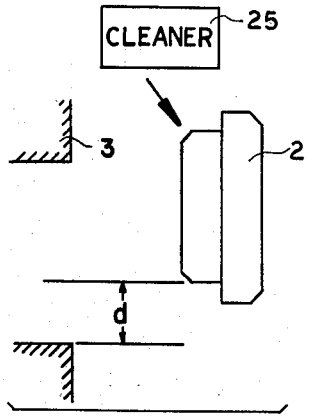
Figure 7E:
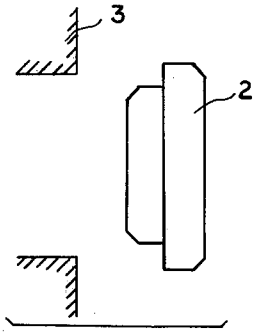
Figure 7F:
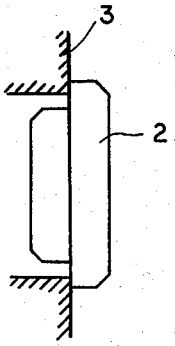
Figure 7G:
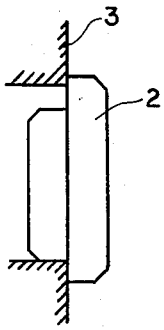

The door can then be reinserted, as shown in FIG. *7f*, and the arms 5 and 6 are dropped back down again to the position A (detected by switch 12) to leave it resting on the sill of the frame 3 as shown in FIG. 7*g*. Thereafter the door-extracting mechanism can move on to the next door.

Figure 8:
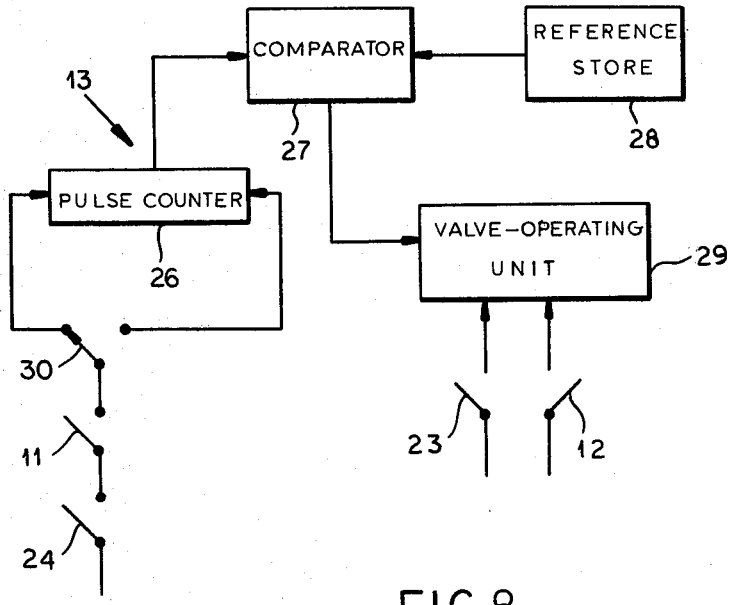
FIG. 8 is a circuit diagram of a controller diagrammatically illustrated in FIG. 6.

In FIG. 8 I have shown the controller 13 as comprising a reversible pulse counter 26 working into one input of a comparator 27 whose other input receives a reference value from a store 28. A valve-operating unit 29, serving to block and unblock the admission of hydraulic fluid to the working cylinder 10 of FIG. 1, is controlled by the comparator 27 in the aforedescribed manner to arrest the lifting arms 5, 6 at the break-free level (A+a+b) as shown in FIG. 3. Switches 12 and 23 of FIG. 6, when closed by the associated cams 17 and 16 in the lower and the upper limiting positions of these arms respectively illustrated in FIGS. 1 and 4, enable the unit 29 to let the cylinder extend its piston for a raising of the door and to retract its piston for a lowering thereof. The forward stepping of pulse counter 26 during upward motion and its downward stepping during backward motion, as described above, is determined by means schematically represented by a reversing switch 30 in series with the engagement-sensing switch 11 and the pulse-generating switch 24.

Figure 5:
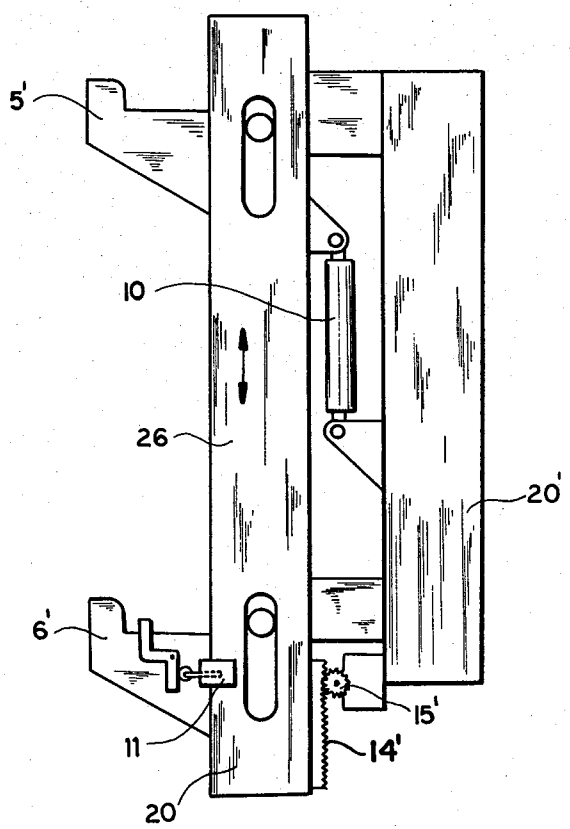
FIG. 5 is a view corresponding to a detail of FIG. 1 but showing an alternative arrangement according to this invention.

It is also possible to form the door-lifting mechanism, as shown in FIG. 5, with a vertically slidable member 26 having a pair of arms 5' and 6' that are slid relative to the vertically nondisplaceable support 20' by means of the cylinder 10. In this arrangement a rack 14' provided on the slidable part 26 operates a pinion 15' with the same function as the pinion 15.

I claim:

1. An apparatus for extracting a door from a frame aperture of a coking oven in which the door is received with a predetermined vertical play, comprising:

a horizontally displaceable support;

lifting means mounted on said support for relative vertical movement between a lower and an upper limiting position separated by a distance substantially exceeding said play, said lifting means being engageable from below with coacting means on said door;

pulse-generating means coupled with said lifting means;

switch means responsive to operative engagement of said lifting means with said coacting means for emitting a start signal;

actuating means mechanically connected with said lifting means for reversibly displacing same; and control means for operating said actuating means, said control means including a pulse counter connected to said pulse-generating means and enabled by said start signal, during an upward stroke of said lifting means from said lower limiting position and with said coacting means engaged, to be stepped forward by said pulse-generating means for counting a number of pulses proportional to the rise of said door in said frame aperture, comparison means with inputs connected to said pulse counter and to a source of a predetermined reference value for emitting a stop signal deactivating said actuating means upon the count of said pulses equaling said reference value to indicate the elevation of said door to a break-free level substantially midway within said frame aperture, said actuating means being reactivable upon a horizontal withdrawal of said door on said support from said frame aperture to continue said upward stroke and the forward stepping of said pulse counter until attainment of said upper limiting position by said lifting means, followed by backward stepping of said pulse counter upon reversal of said actuating means and re-emission of said stop signal by said comparison means upon a return of said door to said break-free level whereby said door can be returned to said frame aperture and lowered into its initial position therein.

2. An apparatus as defined in claim 1 wherein said pulse-generating means comprises a rotatable shaft on said support, a disk with a multiplicity of angularly equispaced peripheral formations on said shaft, and a sensing switch coacting with said formations.

3. An apparatus as defined in claim 2 wherein said lifting means includes an arm pivotally mounted on said support, further comprising a step-up transmission linking said arm with said shaft for translating a swing of said arm between said limiting positions into a partial revolution of said shaft.

4. An apparatus as defined in claim 2 or 3 wherein said control means further includes cam means on said shaft and sensing means responsive to said cam means for arresting said lifting means in either of said limiting positions.

* * * * *